US006196385B1

(12) United States Patent
Thompson et al.

(10) Patent No.: US 6,196,385 B1
(45) Date of Patent: Mar. 6, 2001

(54) GOLF CLUB LOCKING DEVICE

(75) Inventors: Garth Wade Thompson; David Ernest Marchuk; John Charles Goetz; Lewis Jeffrey John Murray, all of Calgary (CA)

(73) Assignee: Techtonic Corporation, Christ Church (BB)

( * ) Notice: Subject to any disclaimer, the term of this patent is extended or adjusted under 35 U.S.C. 154(b) by 0 days.

(21) Appl. No.: 08/807,846

(22) Filed: Feb. 26, 1997

Related U.S. Application Data

(63) Continuation-in-part of application No. 08/503,400, filed on Jul. 17, 1995, now abandoned.

(51) Int. Cl.[7] ..... A63B 55/00

(52) U.S. Cl. ..... 206/315.6; 206/315.3; 70/64

(58) Field of Search ..... 206/315.2–315.4, 206/315.6; 70/58, 64

(56) References Cited

U.S. PATENT DOCUMENTS

| | | | |
|---|---|---|---|
| 1,570,500 | 1/1926 | Kennedy | 206/315.6 |
| 1,599,170 | 9/1926 | Fatjo . | |
| 1,717,959 | 6/1929 | Cauffman . | |
| 1,770,060 | 7/1930 | Barlow . | |
| 1,951,158 | 3/1934 | Locke et al. | 206/315.6 X |
| 4,538,728 | 9/1985 | Lewis | 206/315.3 |
| 4,863,019 | 9/1989 | Lewis et al. | 206/315.3 |
| 5,004,100 | 4/1991 | Smith | 206/315.2 |
| 5,060,796 | 10/1991 | Brooks, III | 206/315.6 |
| 5,094,345 * | 3/1992 | Yonnetti | 206/315.2 |
| 5,267,660 | 12/1993 | Kwon | 211/70.2 |
| 5,431,278 * | 7/1995 | Gretz | 206/315.6 |
| 5,458,240 * | 10/1995 | Rich et al. | 206/315.6 X |
| 5,524,753 | 6/1996 | Murphy | 206/315.6 |
| 5,560,485 | 10/1996 | O'Hara, Jr. | 206/315.4 |
| 5,582,043 * | 12/1996 | McCue et al. | 206/315.4 X |
| 5,590,772 * | 1/1997 | Schuhlen et al. | 206/315.3 |
| 5,610,585 * | 3/1997 | Jobe | 206/315.3 X |
| 5,635,735 * | 6/1997 | Stusek | 206/315.6 |
| 5,699,906 * | 12/1997 | Lombardo et al. | 206/315.4 X |

FOREIGN PATENT DOCUMENTS

| | | | |
|---|---|---|---|
| 2 181 410 | 1/1997 | (CA) . | |
| 2 646 785 | 11/1990 | (FR) | 206/315.6 |
| 2 020 185 | 11/1979 | (GB) . | |
| 2 280 704 | 2/1995 | (GB) . | |
| WO96/04045 | 2/1996 | (WO) . | |

* cited by examiner

*Primary Examiner*—Sue A. Weaver
(74) *Attorney, Agent, or Firm*—Ridout & Maybee

(57) ABSTRACT

A golf club locking device attachable to a golf club bag having a main portion divided into one or more compartments and a mouth portion forming openings in the bag for receiving golf clubs in the compartments. The golf club locking device comprises a locking member and a main member which fastens to the mouth of the golf club bag and includes openings corresponding to the compartments., The locking member is coupled to the main member and slides linearly in relation to the main member between a locked position and an unlocked position. In the locked position, the openings are constricted thereby preventing removal of clubs from the golf bag. The locking device is manufacturable as integral component-of a golf bag.

16 Claims, 7 Drawing Sheets

GOLF CLUB LOCKING DEVICE

This application is a continuation-in-part of Application Ser. No. 08/503,400 filed Jul. 17, 1995, and now abandoned.

FIELD OF THE INVENTION

This invention relates to a golf club locking device for use in combination with a golf bag, and more particularly to a locking device attached to a golf bag for preventing removal of golf clubs when in a closed position and a locking mechanism for securing the device and the golf bag.

BACKGROUND OF THE INVENTION

Golf club locking devices are known in the art. The cost of golf clubs have always made them an attractive target for thieves. In particular, unsecured and unattended golf bags and their contents make a tempting target for unscrupulous types, especially at public golf courses which are easily accessible.

Known locking devices are found in U.S. Pat. No. 4,863,019 to Lewis, U.S. Pat. No. 5,004,100 to Smith, U.S. Pat. No. 1,770,060 to Barlow, U.S. Pat. No. 1,717,959 to Cauffman, and U.S. Pat. No. 5,524,753 to Murphy.

The Cauffman patent discloses a device which is attached to the opening of a golf bag. When in the locked position, the device prevents the removal of golf clubs from the bag. The device comprises a circular base plate and a circular club locking member. The circular base plate has a series of circular openings for the shafts and grip ends of the golf clubs. The club locking member comprises a rotatable disk which is provided with corresponding openings for receiving the shafts of the clubs. The club locking member is rotatable between a normal position and a locked position. In the locked position, the locking member prevents the clubs from being pulled from the bag by constricting the openings around the shafts and grip ends of the clubs.

The device taught by Cauffman is cumbersome to use while golfing because the clubs must be individually inserted through the openings. In addition, the circular base and club locking plates severely restrict access to the inside of the golf bag and the number of golf clubs which can be carried (and secured) is limited by the number of openings. The size of the circular openings also means that clubs with small diameter shafts will be loosely held in the locked position. Furthermore, the disc shape of the locking member and accompanying circular movement makes the Cauffman unsuitable for use with golf bags which do not have a circular mouth.

The Murphy patent discloses a device for securing golf clubs in a golf bag. The device taught by Murphy fits over the top of a golf bag and is fastened by a strap assembly. The Murphy device comprises two stationary plates with a sliding plate disposed between the stationary plates. Each of the plates includes slots for allowing golf clubs to be inserted and removed from the bag. To secure the golf clubs in the bag, the sliding plate is moved forward to constrict the slot openings around the shafts of the clubs. The sliding plate includes a locking tab for receiving an external padlock shackle for locking the position of the sliding plate to prevent the plate from opening so that the clubs cannot be removed from the slots.

While the Murphy provides an improved golf club security device over the prior art devices, there are still drawbacks associated with the Murphy device. First, the arrangement of shifting plates as taught by Murphy is severely limited in practical application to golf bags because it effectively reduces golf club carrying capacity by closing off the open top of the bag. A minimum opening space is required in order to be able to easily insert and remove clubs in a golf bag. The Rules of Golf allow a golfer to carry a maximum of fourteen clubs, but many amateurs will carry more than fourteen clubs in addition to a ball retriever and other golf aids which are stored inside the club compartment. The sliding plate and slot arrangement taught by Murphy effectively reduces the opening space in the golf bag and thus the capacity of the bag. In order to accommodate more clubs, the Murphy device is either removed by the golfer during play or the slot size in the plates needs to be increased. Detaching the Murphy locking device for a round of golf would necessitate the removal of all the golf clubs, and then the installation and reinsertion of the clubs at the end of the round - clearly an undesirable mode of operation or option. Therefore to increase club capacity, the slot size in the Murphy device needs to be enlarged. This means that the diameter of the device must also be increased to accommodate the larger slots and the increased travel length of the sliding plate to effectively close the slots around the club shafts. Thus to provide the desired golf club capacity results in an increase in the diameter of the golf bag. Such an arrangement restricts the application of the Murphy device to golf bags with large enough diameters to accommodate the plates, This makes the Murphy device unsuitable for use with most smaller golf bags without sacrificing club carrying capacity. This shortcoming is further magnified by the trend to smaller and lighter golf bags.

Another drawback of the Murphy device is the potential incompatibility with the bag top geometry of existing golf bags. The geometry of present golf bag tops is becoming more complex to facilitate better club organization. The addition of the Murphy device to a golf bag with an oval shape, tear drop or with a compartmented top increases the geometry of the bag top and inevitably leads to a further decrease in capacity. This means that in practical terms the Murphy device is suitable for use with open top bags having a substantially circular shape.

Another drawback associated with the Murphy golf club security device is the need for an external padlock to secure the plates in the locked and open positions. The sliding plate and bottom plate each include a locking "lip" or tab having holes which are aligned in the respective locked and open positions. To secure the plates, the shackle of a padlock is passed through the respective aligned holes in the locking lips. If it is desired to secure the bag to a fixed object, such as a bag rack, then a cable of sufficient length is passed around the object and coupled to the shackle of the padlock. Therefore according to Murphy, it is necessary to carry along a separate padlock and cable in order to secure the plates and/or golf. It will be appreciated that a lock and cable is inconvenient to store in the golf bag because of the rigidity of the cable and the necessity to use precious pocket space which on most lightweight golf bags in use today is already at a premium. Furthermore, should the padlock or cable be lost or left behind, the utility of the device is destroyed because the plates can no longer be secured in the locked position.

In the Murphy device, the sliding plate is secured in locked position by inserting a padlock shackle through the respective holes in the locking tabs on the sliding and bottom plates. While such an arrangement prevents moving the sliding plate to the open position, the single tab restraint point and circular geometry of the sliding plate makes it possible to pry or torque the plate and cause side shifting which would extend the opening size of the slot at one end and thereby allow the club to be removed even though the sliding plate is in the locked position.

The security device taught by Murphy also includes "tabs", a cuff and a strap for fastening the device to the golf bag. This arrangement leads to another disadvantage arising from the fact that it does not accommodate the D-ring which is found on the vast majority of golf bags in use today. The D-ring provides a swivel for attaching the top end of a shoulder strap. The D-ring is preferably positioned as high as possible on the bag top to ensure that the bag does not become top-heavy and tip to spill clubs when carried. On carry bags, the balance point is of critical importance because the bag is carried in a horizontal position under the arm with the strap being supported on the golfer's shoulder. The arrangement of the tabs, cuff and strap in the Murphy device impedes the operation of the D-ring and impairs to the ability to comfortably carry the bag, thereby limiting the use of the device to golfers who use a pull cart or a power cart.

To provide improved golf club organization, some modern golf bags utilize an elevation in the bag top. The bag top is higher at one end for accommodating longer clubs, such the metal woods, and lower at the other end for shorter clubs, such as the wedges. The Murphy device in its present configuration is intended for installation on a flat plane. If the Murphy device is installed on a bag top with an elevation, the sliding plate would tend to move to the closed position due to gravity. This means that during play a padlock would have to be used to secure the sliding plate in the open position. If the Murphy device is installed the other way, i.e. sliding plate is biased in open position, then the sliding plate and the clubs must all be shifted into order to move the plate to the closed position and thereby secure the golf clubs in the bag. The fact that the sliding plate comprises a relatively thick sheet of solid material and the weight of steel shaft clubs makes this a cumbersome task.

Accordingly, there is still a need for a golf club locking device which is suitable for use with golf bags having different top geometries without decreasing the club carrying capacity of the golf bag. There is also a need for golf club and bag locking device which is integrated with the golf bag.

BRIEF SUMMARY OF THE INVENTION

The present invention provides a golf club locking device fastened to a golf bag for locking golf clubs in the bag and includes a lock mechanism for securing the locking device and also securing the golf bag to another object such as a golf bag races or golf cart.

It is an object of the present invention to provide a golf club locking device which can be integrated with golf bags having a variety of shapes.

It is another object of the present invention to provide a golf club locking device which allows full access to the inside of the golf bag without diminishing club carrying capacity, without affecting the ease with which clubs can be replaced in the bag and which secures all the clubs carried in the golf bag without limiting the number of golf clubs.

It is also an object to provide a golf club locking device which is lightweight and economical to manufacture. It is yet a further object to provide a golf club locking device which can manufactured as an integral component of a golf bag.

It is another object of the present invention to provide a golf club locking device which includes features for facilitating the organization of the golf clubs carried in the bag.

It is an object to provide a locking mechanism which is integrated with the golf bag for securing the golf club locking device and also the golf bag.

In a first aspect, the present invention provides a golf club locking device for a golf club bag, the golf club bag having a main portion divided into one or more compartments and a mouth portion forming openings in the bag for receiving golf clubs in the compartments, said golf club locking device comprising: (a) a main member having means for attaching to the mouth of the golf club bag, and the main member having openings communicating with the compartments; (b) a locking member disposed below the main member; and (c) tracking means for linearly guiding movement of the locking member in relation to the main member to a first position to prevent removal of golf clubs contained in the compartments and to a second position to permit removal of the golf clubs, in the first position the locking member constricting the openings to engage the golf clubs.

In a second aspect, the present invention provides a securable golf bag comprising: (a) a main portion divided into a plurality of, compartments and a mouth portion forming openings in the bag for receiving golf clubs in the compartments; and (b) a golf club locking device comprising, (i) a main member having means for attaching to the mouth of the golf club bag, and the main member having openings communicating with the compartments; (ii) a locking member disposed below the main member; and (iii) tracking means for linearly guiding movement of the locking member in relation to the main member to a first position to prevent removal of golf clubs contained in the compartments and to a second position to permit removal of the golf clubs, in the first position the locking member constricting the openings to engage the golf clubs.

In a third aspect, the present invention provides in combination with a golf bag having a main portion divided into one or more compartments and a mouth portion forming openings in the bag for receiving golf clubs in the compartments, the golf club locking device comprising: (a) a main member having means for attaching to the mouth of the golf club bag, and the main member having openings communicating with the compartments; (b) a locking member disposed below the main member; (c) tracking means for linearly guiding movement of the locking member in relation to the main member to a first position to prevent removal of golf clubs contained in the compartments and to a second position to permit removal of the golf clubs, in the first position the locking member constricting the openings to engage the shafts of the golf clubs; and (d) lock means for locking the device in the first and second positions.

In another aspect, the present invention provides a lock mechanism for use with a golf bag with a golf club locking device attached to the mouth of the golf bag and having openings for inserting and removing golf clubs and means for engaging the golf club locking device in a locked position for preventing removal of the clubs from the openings, the lock mechanism comprising: (a) a cable attached to the golf bag, the cable having a locking end, (b) a lockable receptacle for receiving the locking end of the cable; and (c) a lock for securing the lockable receptacle and preventing removal of the locking end of the cable.

In yet another aspect the present invention provides a golf bag comprising: (a) a body portion having a plurality of dividers, the dividers having one end attached to the bottom of the golf bag and forming compartments; (b) a mouth portion for providing access to the body portion for inserting golf clubs in the compartments, and the mouth portion including, (i) a main member having means for attaching to the mouth portion of the golf club bag, and the main member having openings communicating with the compartments; (ii) a moving member disposed below the main member, and the moving member including fastener means for fastening the other end of each of the dividers; (iii) tracking means for guiding movement of the moving member in relation to the main member, and the dividers moving in cooperation with the moving member.

In another aspect, the present invention provides a method for applying a protective layer to club contacting surfaces on a member of a golf bag, said method comprising the steps of: applying a heat sensitive adhesive to the club contacting surfaces of said golf bag member; placing said heat sensitive adhesive and said golf bag member in a mould; heating a thermoplastic laminate sheet having a padded portion to a predetermined temperature; indexing said heated thermoplastic laminate sheet over said mould and said golf bag member prepared with the heat sensitive adhesive; drawing said heated thermoplastic laminate sheet into contact with said prepared golf bag member; activating said heat sensitive adhesive to create a bond between said heated thermoplastic laminate sheet and said prepared golf bag member; trimming excess portions of the bonded thermoplastic laminate sheet.

BRIEF DESCRIPTION OF THE DRAWINGS

Reference will now be made, by way of example, to the accompanying drawings which show a preferred embodiment of the present invention, and in which:

FIG. 5 (*b*) is an end view of another embodiment of a tracking guide for the golf club locking device of FIG. 1;

DETAILED DESCRIPTION OF THE PREFERRED EMBODIMENTS

Figure 1:
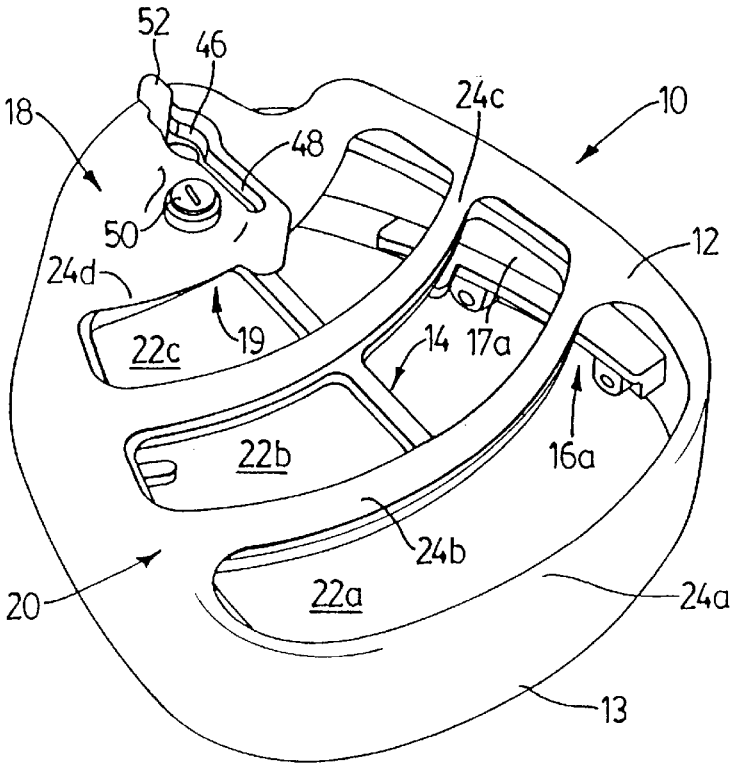
FIG. 1 is a perspective view of a golf club locking device according to the present invention in an unlocked position.

Reference is made to FIGS. 1 to 5(*a*) which show a first embodiment of a golf club locking device 10 according to the present invention. Like reference numerals indicate like elements in FIGS. 1 to 5(*a*).

As shown in FIGS. 1 to 5, the golf club locking device 10 comprises a top member 12, a sliding locking member 14 and a pair of tracking guides 16 shown individually as 16*a*, 16*b*. The sliding locking member 14 is mounted inside the top member 12 and is disposed and located below the top member 12. The locking Member 14 includes rails or bars 17 shown individually as 17*a*, 17*b* which are seated in the respective tracking guides 16*a*, 16*b*. The tracking guides 15 cooperate with the rails 17 to guide the locking member 14 along a linear path between an unlocked position shown in FIG. 1, and a locked position shown in FIG. 2.

The locking device 10 is fastened to the top of a golf bag 11 (FIG. 6) and replaces the conventional bag top and skirt or collar assembly which is attached to the bag during the manufacturing process. The top member 12 has a lower edge 13 which forms a skirt or collar that mates with the opening of the golf bag 11. The top member 12, the sliding locking member 14 and the tracking guides 16 are preferably injection moulded from a thermoplastic material using known techniques.

Figure 6:
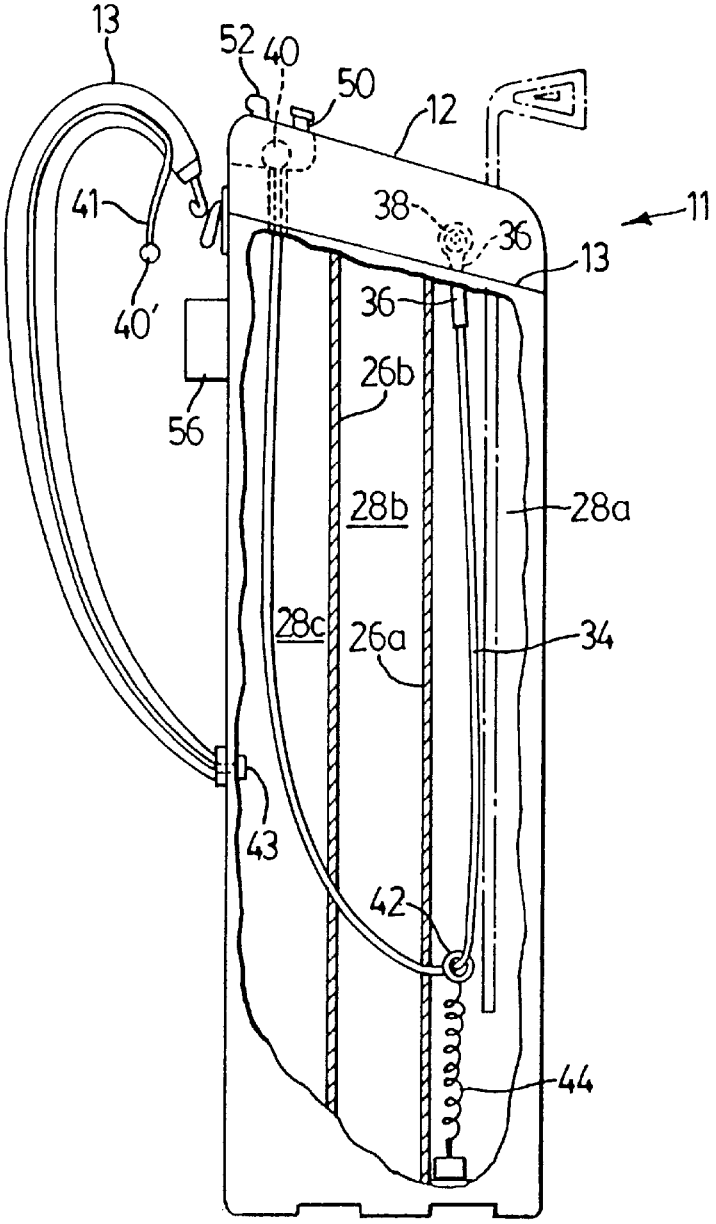
FIG. 6 is a partial cut-away view of a golf bag incorporating a locking mechanism according to another aspect of the present invention.

As shown in FIG. 1, the top member 12 comprises a control panel 18 and a compartment access portion 20. The compartment access portion 20 has one or more openings 22 shown individually as 22*a*, 22*b*, 22*c* which are bordered by a front member 24*a*, cross members 24*b* and 24*c* and a rear member 24*d*. The locking device 10 is attached to the top of the golf bag 11 (FIG. 6). If the golf bag 11 has partitions or dividers 26 shown individually as 26*a*, 26*b* which form compartments 28*a*, 28*b*, 28*c* (FIG. 6), then the cross members 24*b*, 24*c* register with the partitions 26*a*, 26*b* to provide full access to the compartments 28*a*, 28*b*, 28*c*. The partitions typically comprise flexible panels made from fabric and 26*a*, 26*b* are preferably secured to the sliding locking member 14, using a suitable fastener 67 as shown in FIG. 1 for partition 26*a* (partial view), for example a hook and loop fastener strips sold under the brand name: VELCRO™. In this arrangement, the partitions 26 are secured by the sliding plate 14 and also move along with the sliding plate 14 as it is moved.

Figure 2:
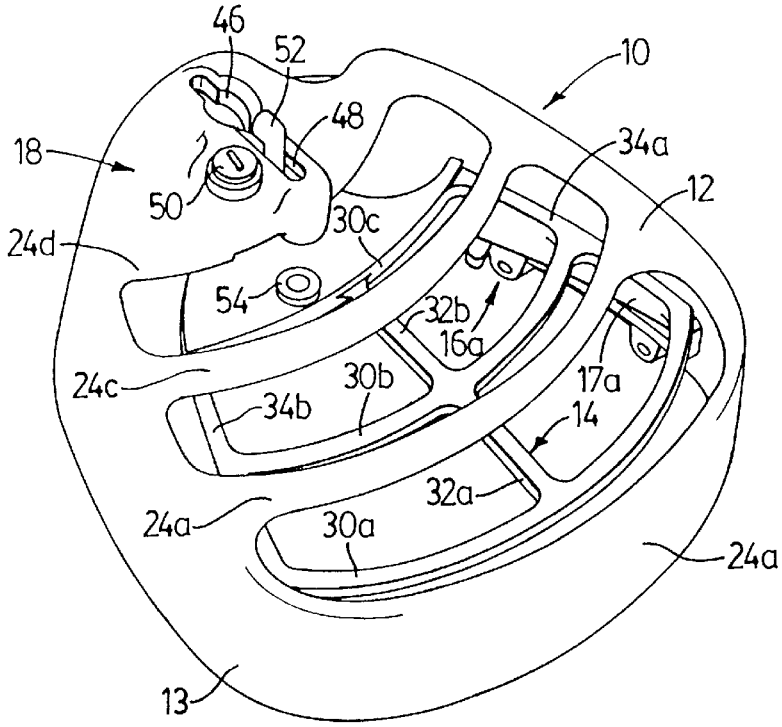
FIG. 2 is a perspective view of the golf club locking device of FIG. 1 in a locked position.
Figure 4:
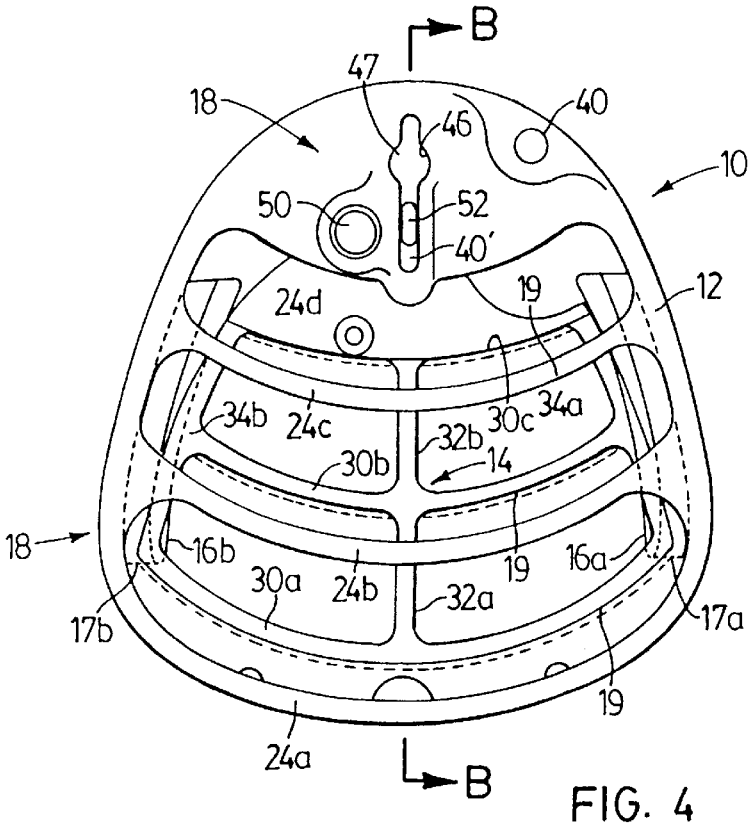
FIG. 4 is a top view of the golf club locking device of FIG. 1 in the locked position.
Figure 5A:
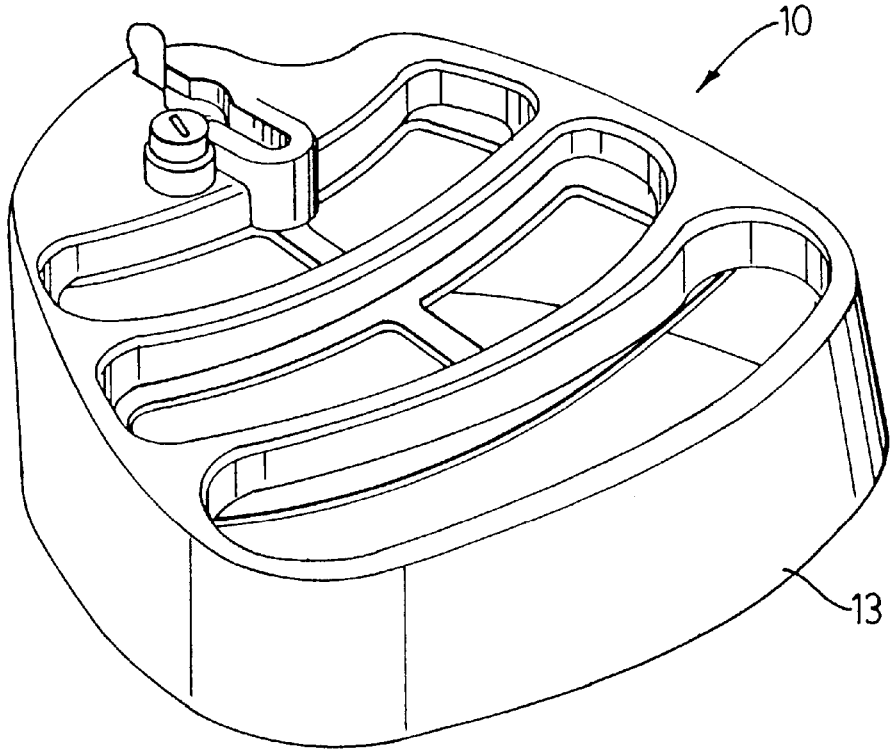
FIG. 5 (*a*) is a three-dimensional perspective depiction of the golf club locking device of FIG. 1.
Figure 5B:
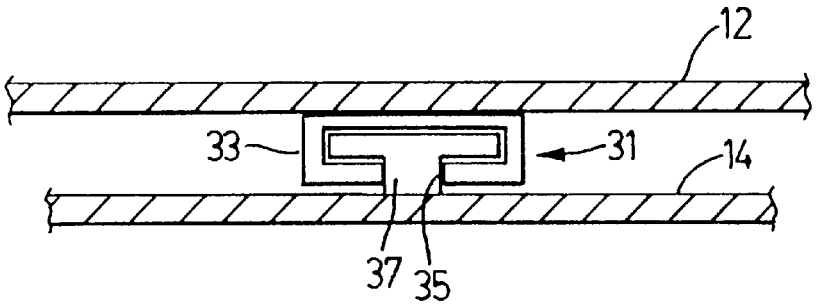

As shown in FIGS. 2 and 4, the locking member 14 comprises a frame formed with bars 30 shown individually as 30*a*, 30*b*, 30*c*, partition members 32*a*, 32*b* and side members 34*a*, 34*b*. In the locked position, the sliding member 14 is moved forward and the openings 22*a*, 22*b*, 22*c* are constricted between the bars 30*a*, 30*b*, 30*c* and the members 24*a*, 24*b*, 24*c* which prevents the removal of golf clubs by reducing the width of the openings 22 around the larger diameter of the club shafts at the grip ends. The side members 34*a*, 34*b* include the rails or bars 17*a*, 17*b* which cooperate with the respective tracking guides 16*a*, 16*b* to linearly guide the movement of the member 14. The arrangement of the side members 34*a*, 34*b* and the tracking guides 16*a*, 16*b* provides a fixed linear motion of the sliding member 14 and prevents side-to-side play. In another embodiment, the two tracking guides 16*a*, 16*b* are replaced by a single tracking guide 31 (FIG. 5(*b*)) which is positioned essentially in the middle of the top member 12, i.e. coincident with the members 32*a*, 32*b*. The single tracking guide 31 comprises a channel 33 having a restricted opening 35 and a transverse flange 37 which is held captive in the channel 33. As shown in FIG. 5(*b*), the transverse flange 37 is attached (or formed) on the top side of the locking member 14 and comprises a "T"0 shape. The channel 33 (i.e. tracking guide) is affixed to the bottom of the top member 12 and comprises the restricted opening 35 which supports and guides the transverse flange 37. Such an arrangement still has the advantage of fixing the linear movement of the sliding member 14 between the closed and open positions and preventing side-to-side play of the member 14.

Figure 3:
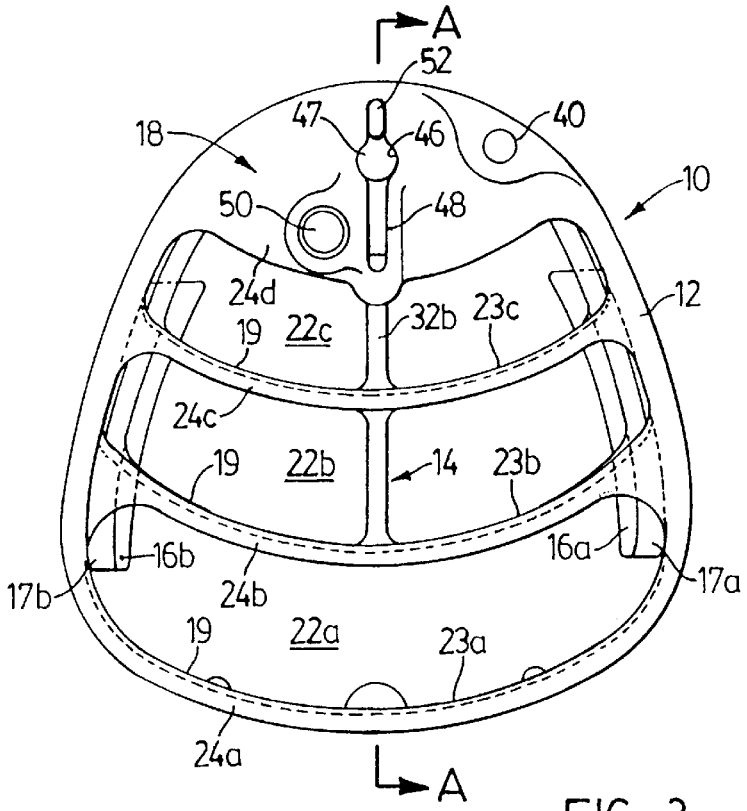
FIG. 3 is a top view of a golf club locking device of FIG. 1 in the unlocked position.

The partition members 32*a*, 32*b* as shown in FIG. 3 further subdivide the openings 22*b* and 22*c*. If the golf bag 11 includes compartment sub-dividers, i.e. centre dividers, the members 32*a*, 32*b* preferably register or align with the compartment sub-dividers in the golf bag 11. The sub-dividers or centre dividers are secured to the members 32*a*, 32*b* of the sliding plate 14 in a similar fashion as described above for the partitions 26*a*, 26*b*, e.g. using hook and loop fasteners.

As shown in FIGS. 1, 2 and 5, the openings 22 have a contoured or concave shape. The concave shape of the openings 22 promotes the movement of the club shafts against locking edges 23 shown individually as 23*a*, 23*b*, 23*c* (FIG. 3) of the respective openings 22*a*, 22*b*, 22*c* when the golf bag 11 is tilted or shifted. This facilitates the closing or constriction of the openings 22 around the club shafts when the sliding member 14 is moved to the locked position. The collecting action of the contoured openings 22 is enhanced when the locking device 10 is mounted on a golf bag having an angled top with an elevation as shown in FIG. 6. Advantageously, the contoured shape of the openings 22 in cooperation with the tracking guides 16 also makes it difficult to torque or pry the sliding member 14 to one side and force open one end of the opening 22 to pull out a golf club when in the closed position.

Referring to FIGS. 2 and 4, the control panel 18 on the top member includes an integrated lock mechanism for locking the sliding member 14 in the open and the closed position. The lock mechanism is described in more detail below with reference to FIGS. 6 to 8. The control panel 18 as shown in FIG. 1 also provides a recess 19 for receiving the end of the sliding member 14 in the open position so that the sliding member 14 registers with the members 24*b*, 24*c* and 24*d* in the top member 12. This arrangement advantageously provides seamless access to the compartments 28*a*, 28*b*, 28*c* of the golf bag 11 when the sliding member 14 is in the open position. Further in the closed position, the sliding member 14 does not extend beyond the periphery of the top member 12 which prevents the sliding member 14 from interfering with the external D-ring or loops round on most golf bags.

Figure 7:
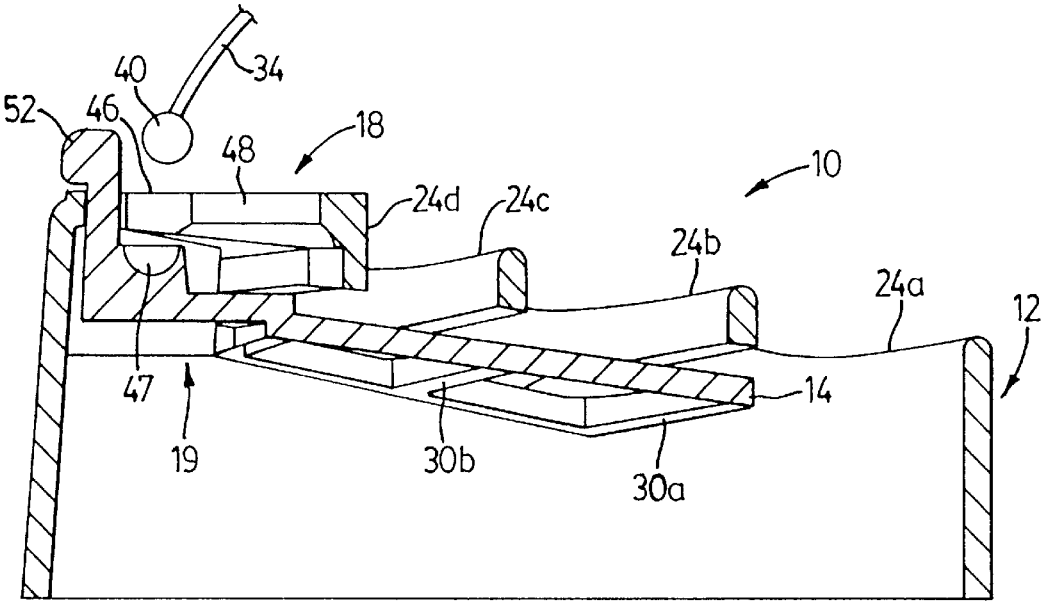
FIG. 7 is a sectional view of the golf club locking device taken along line A—A in FIG. 3.
Figure 8:
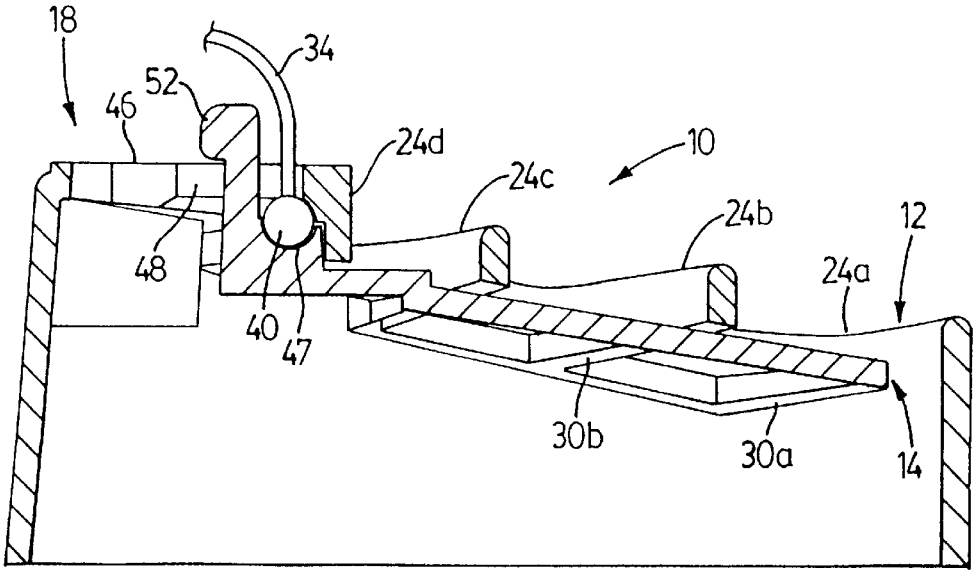
FIG. 8 is a sectional view of the golf club locking device o FIG. 4 taken along line B—B.

As shown in FIGS. 7 and 8, the front member 24*a* and cross members 24*b* and 24*c* preferably have rounded top edges. The rounded top edges facilitate insertion and removal of clubs from the golf bag. The rounded edges also eliminate the sharp edges which tend to nick and damage the graphite shafts found on the more expensive metal woods and irons.

To provide additional protection for graphite shafts, a protective layer 66 (shown in broken outline in FIGS. 3 and 4) is formed on the surfaces which come into contact with the club shafts such as the edges 23 of the openings 22 and the bars 30. The protective layer 66 preferably comprises a padded and abrasive resistant skin which is applied by a thermo-forming process to the club contacting surfaces. The thermo-forming process comprises the following steps: (1) application of a heat sensitive adhesive to the club contacting surfaces of the bars 30 and the openings 22; (2) placement of the components on a mould; (3) heating a thermoplastic laminate sheet by radiant or convective heat to the required temperature; (4) indexing the heated thermoplastic laminate sheet over the mould and prepared injection moulded part; (5) using vacuum or air pressure to draw the heated laminate sheet into contact with, and to the shape of, the prepared club contacting surface (e.g. bar 30 on the sliding member 14) and activating the adhesive to create a bond between the components; and (6) trimming the excess material from the moulded components.

The protective layer 66 may also be formed using known processes and materials, such as co-injection of Santoprene™ or flocking a fibrous composition to the surfaces of the bars 30 and edges.

Reference is next made to FIG. 6 which shows a locking mechanism according to another aspect of the present invention. The locking mechanism is integrated with the golf club locking device 10 and the golf bag 11. The locking mechanism is accessed through the control panel 18.

The integrated locking mechanism comprises a retractable wire cable 34 which is located in the interior of the golf bag 11 and fixed to the inside of the top member 12 using a suitable fastener, for example, a conventional grommet 36 and a rivet 38. The other end of the cable 34 is attached to a restraint or locking member, such as a ball 40. The cable 34 is threaded through a ring or pulley 42 which is coupled to the base of the bag 11 by a spring 44. The spring 44 biases the cable 34 in a retracted position inside the bag 11, but allows the cable 34 to be extended from the bag 11 or top member 12 with the application of a pulling force to the ball 40. The spring 44 may be replaced by a sprung spool or an elastic cord arrangement with sufficient tension to bias the cable 34 in the retracted position.

As shown in FIG. 3, the ball 40 is accessed on the control panel 18. Referring to FIG. 3, the control panel 18 includes an aperture 46 for inserting the ball 40 into a socket 47 which is formed in the sliding member 14 (FIG. 7). The socket 47 communicates with a locking track or channel 48 which is formed in the control panel 18. The control panel 18 also includes a lock 50, and the sliding member 14 includes a lever 52 which projects through the aperture 46 and channel 48. The lever 52 is formed in the sliding member 14 (FIG. 7) and facilitates moving the sliding member 14 between the unlocked position (FIGS. 1 and 3) and the locked position (FIGS. 2 and 4). In operation, the lever 52 constricts the channel 48 and prevents the ball 40 from being removed from the aperture 46 when the sliding locking member 14 is in the locked position (FIGS. 2 and 4).

The lock 50 comprises a conventional plunger lock having a cylinder or piston which is movable between an extended and a retracted position and locked in position by a key or a combination lock mechanism. The plunger lock 50 secures the sliding member 14 in the locked and unlocked positions. In the locked position, the lock 50 also prevents movement of the sliding locking member 14 and movement of the lever 52 secures the ball 40 and cable 34 if inserted in the socket 47.

To secure the sliding member 14 in the unlocked position, the plunger lock 50 is actuated so that the cylinder registers with a first hole 54. The first hole 54 is aligned with the plunger lock 50 when the sliding member 14 is fully retracted in the unlocked position as shown in FIGS. 1 and 3. The ability to secure the sliding member 14 in the unlocked position is useful to prevent the sliding member 14 from shifting position when the clubs are being used for play. To secure the sliding member 14 in the locked position, the sliding remember 14 includes a second hole (not shown) which registers with the plunger lock 50 when the sliding member 14 is moved into the locked position (FIGS. 2 and 4). The clubs are secured in the golf bag 11 by moving the sliding member 14 to the closed position (FIG. 4), depressing and thereby locking the plunger lock 50 so that the cylinder engages the second hole. Advantageously, this arrangement also allows the golf clubs to be conveniently secured to prevent rattling and shifting during play which could nick or damage the graphite shafts. To secure the golf clubs, the sliding member 14 is moved to the closed position and the plunger lock 50 is depressed to engage the member 14. To retrieve a club for a golf shot, the plunger 50 is unlocked and disengaged, the member 14 is moved to the open position, and the club removed. This feature is particularly useful when the golf bag is being carried on a power cart where there is a tendency for shaking and rattling of the golf clubs inside the golf bag compartments.

The locking mechanism according to this aspect of the invention also provides the capability to secure the golf bag 11 to a fixed object, such as a bag rack or a fence post, by pulling on the ball 46 to extend the cable 34, wrapping the cable 34 around the fixed object, and inserting the ball 40 into the socket 47 through the aperture 46, The cable 40 is then secured in the locked position by using the lever 52 to move the member 14 until the cylinder for the lock 50 registers with the second hole of the sliding member 14 in the closed position. When moved to the closed position, the locking channel 48 and ever 52 prevent the ball 40 and cable end 34 from being removed from the socket 47. The plunger 5 is then depressed to engage the sliding member 14 and locked with the key or combination lock. The golf bag 11 may now be left unattended with peace of mind knowing that the clubs are secured inside the bag 11 and the bag 11 itself is secured to the rack. An attempt to break the security of the golf locking device 10 would not go unnoticed to bystanders.

In another embodiment of the locking mechanism, a ball assembly 40' is coupled to the top of the carrying or shower strap 77 by a cable 41 as shown in FIG. 6. The ball 40' in conjunction with the shoulder strap 77 replaces the ball 40 and cable 34 assembly. The cable 41 is preferably integrated with the shoulder strap 77 and secured to the wall of the bag 11 using a fastener 43 such as grommet and rivet.

To secure the golf bag 11 to a fixed object, e.g. a bag rack, the top of the shoulder strap 77 is detached from the D-ring and wrapped around the bag rack. The ball 40' is then seated into the socket 47 and secured by the locking channel 48 and the lever 52 when the member 14 is moved to the closed position and locked by the plunger 50. This embodiment has the advantage of eliminating the need for the retractable cable 34 mounted inside the golf bag 11. In addition, the a thicker cable 41 can be used.

Figure 13:
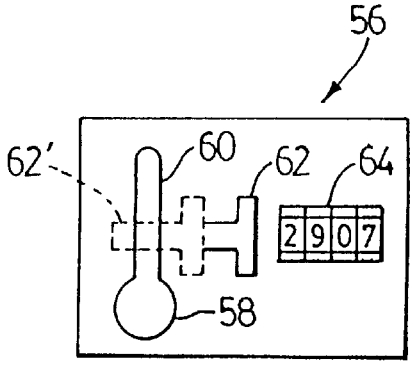
FIG. 13 is a top view of a locking unit according to another embodiment of the present invention.

According to another aspect of the present invention, the shoulder strap 77 and locking cable 41 combination is secured by a locking unit 56. The locking unit 56 is affixed to the side of the bag 11 as shown in FIG. 6. As showing in FIG. 13, the locking unit 56 comprises a socket 58 and channel 60 for receiving the ball 40' and cable 41, and a plunger 62 and combination (or key lock) 64. To secure the golf bag 11, the shoulder strap 77 (and cable 41) are detached from the D-ring and wrapped around an object, e.g. a fence post. The ball 40' and cable 41 are inserted into the socket 58 and slid to the end of the channel 60. The plunger 62 is then moved to the locked position shown in broken outline 62' and the combination lock 64 locks the position of the plunger 62'. To unlock the cable 41, the combination is entered in the lock 64 and the plunger 62 is moved back to allow the ball 40' and cable 41 to be slid to the socket 58 and removed. Advantageously, this arrangement allows the locking mechanism according to the present invention to be used with a golf bag which is not equipped with the golf club locking device 10.

Reference is next made to FIGS. 9 to 12 which show another embodiment of a golf club locking device 10' according to the present invention. Like references indicate like elements in the drawings.

Figure 10:
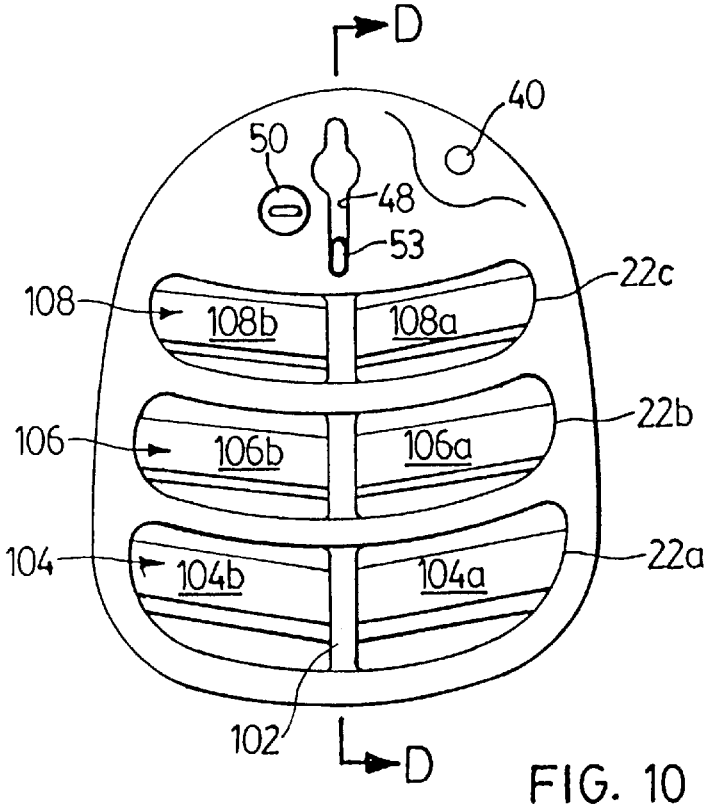
FIG. 10 is a top view of the golf club locking device of FIG. 9 in a locked position.
Figure 11:
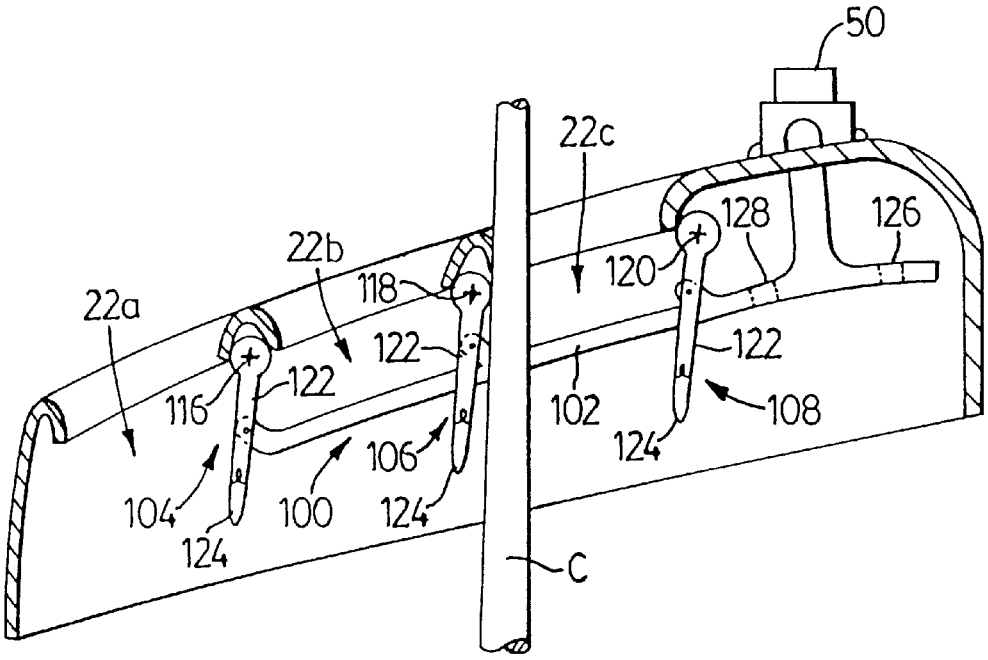
FIG. 11 is a sectional view of the golf club locking device of FIG. 9 taken along line C—C.

For the golf club locking device 10', the sliding member 14 is replaced by a shutter arrangement 100. The shutter arrangement 100 as shown in FIGS. 10 and 11 comprises a lever arm 102 and three shutters 104, 106, 108 each of which span a respective opening 22*a*, 22*b*, 22*c*. Each of the shutters 104, 106, 108 is coupled to the lever arm 102 at a respective lower pivot point 110, 112, 114. The shutters 104, 106, 108 are also coupled to the top member 12 at respective upper pivot points 116, 118, 120. The upper pivot points 116, 118, 120 each comprise a shaft spanning the width of the top member 12 and suitably attached to the member 12 to permit the shutters 104, 106, 108 to swing between an open and a closed position in response to actuating the lever arm 102.

Figure 9:
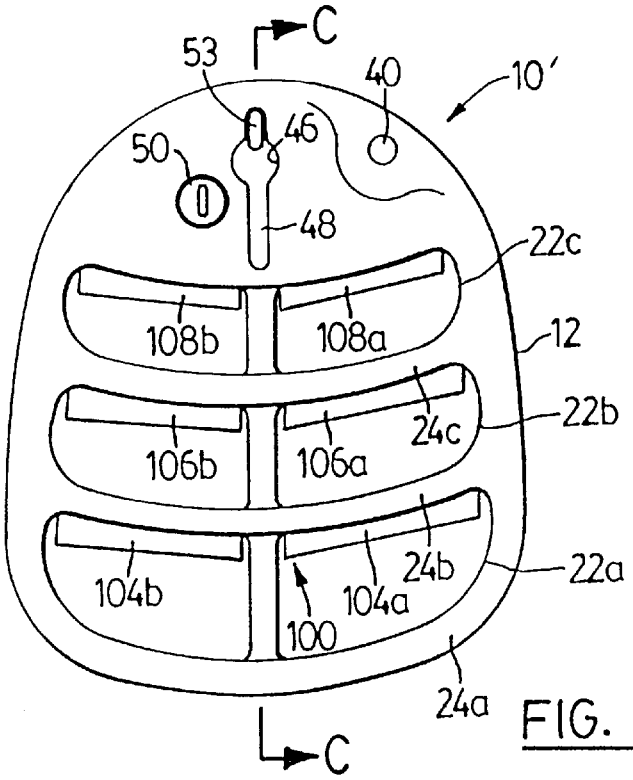
FIG. 9 is a top view of another embodiment of a golf club locking device according to the present invention in an unlocked position.

As shown in FIGS. 9 and 10, the lever arm 102 substantially bisects the top member 12 and is aligned with the locking channel 48. Each shutter 104, 106, 108 comprises two sections 104*a* and 104*b*, 106*a* and 106*b*, 108*a* and 108*b* which together span the respective opening 22. The lever arm 102 includes an actuator 53 which projects through the channel 48 and provides a means for actuating, i.e. moving the lever arm 102 between a closed position indicated by arrows 103 in FIG. 12 and an open position as shown in FIGS. 9 and 11. The shutter arrangement 100 is secured in the open and locked positions using a locking mechanism as will be described below.

Figure 12:
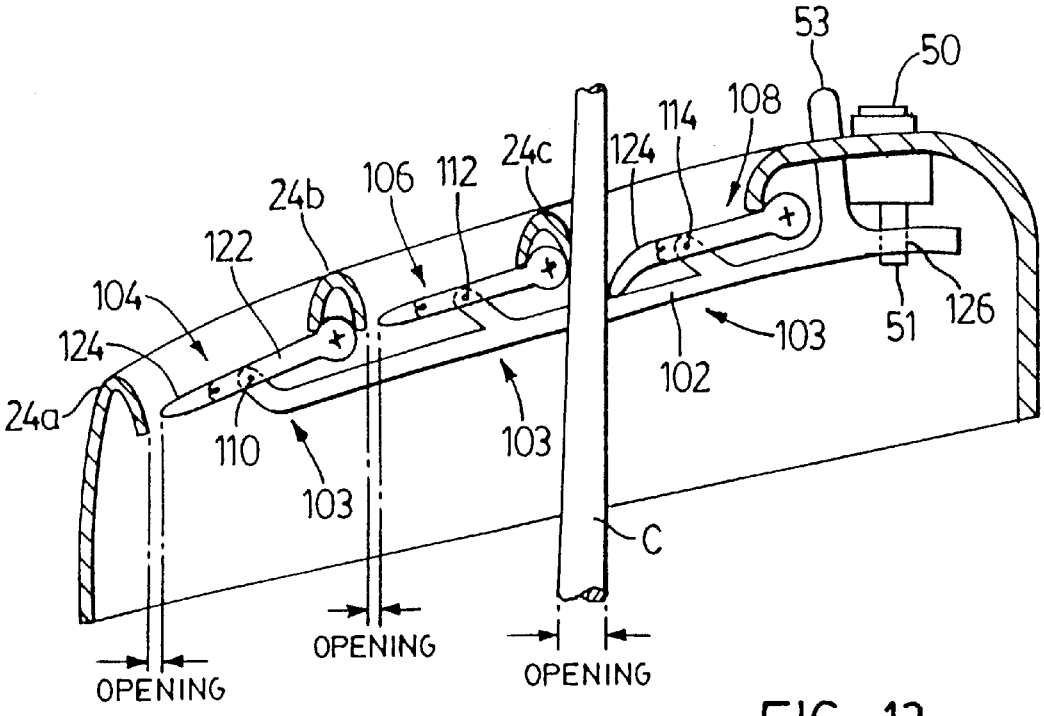
FIG. 12 is a sectional view of the golf club locking device of FIG. 10 taken along the line D—D.

Referring to FIG. 12, the shutters 104, 106, 108. preferably comprise an upper portion 122 and a graphite protection lower portion 124. The upper portion 122 is made from a suitable thermoplastic material, while the lower portion 124 includes a suitable graphite protection layer which is applied or integrated as described above. When the shutters 104, 106, 108 are moved to the closed position, the shutters 104, 106, 108 constrict the openings 22*a*, 22*b*, 22*c* to prevent removal of golf clubs by reducing the width of the openings 22 around the larger diameter of the club shafts at the grip ends. In another aspect, the lower portion 124 is formed from a semi-rigid material which provides some deflection while still constricting the openings 22 when the mechanism 100 is moved to the closed position.

As also shown in FIGS. 11 and 12, the lever arm 102 includes an aperture 126 for cooperating with the plunger lock 50 and securing the lever arm 102 and shutters 104, 106, 108 in the closed position. As shown in FIG. 12, the aperture 126 registers with the cylinder or piston 51 of the plunger lock 50 when the lever arm 102 is moved to the closed position 103. By actuating the plunger lock 50, the cylinder 51 extends through the aperture 126 and bars movement of the lever arm 120 and the opening of the shutters 104, 106, 108. (As described above, the extended cable 34 and ball 40 may also be inserted into the socket 47 before the shutters 104, 106, 108 are closed to secure the bag 11 to a fixed object.) The lever arm 102 may also include another aperture 128 for securing the shutters 104, 106, 108 in the open position when the lever arm 102 is fully retracted.

In another embodiment, the skirt 77 on the top member 12 is replaced by a series of tabs Each of the tabs includes an aperture for receiving a fastener for attaching to the mouth of the bag 11. This arrangement allows the locking device 10 to be retrofitted on an existing golf bag. It will be appreciated that the arrangement of the tabs and/or fasteners will depend on the manufactured structure of the golf bag to be fitted.

The present invention may be embodied in other specific forms without departing from the spirit or essential characteristics thereof. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A golf club locking device for a golf club bag, the golf club bag having a main portion divided into one or more compartments and a mouth portion forming openings in the bag for receiving golf clubs in the compartments, said golf club locking device comprising;

(a) a main member having means for attaching to the mouth of the golf club bag, and said main member having openings communicating with said compartments;

(b) a locking member disposed below said main member; and (c) tracking means for linearly guiding movement of said locking member in relation to said main member to a first position to prevent removal of golf clubs contained in said compartments and to a second position to permit removal of the golf clubs, in said first position said locking member constricting said openings to engage the golf clubs;

(d) said tracking means comprising a channel and a transverse flange, said channel having a restrictive opening and being affixed to the lower surface of said main member, and said transverse flange being affixed to the upper surface of said locking member and held captive in said channel, so that said channel in cooperation with said transverse flange guides the linear movement of said locking member.

2. A golf club locking device for a golf club bag, the golf club bag having a main portion divided into one or more compartments and a mouth portion forming openings in the bag for receiving golf clubs in the compartments, said golf club locking device comprising:

(a) a main member having means for attaching to the mouth of the golf club bag, and said main member having openings communicating with said compartments;

(b) a locking member disposed below said main member;

(c) tracking means for linearly guiding movement of said locking member in relation to said main member to a first position to prevent removal of golf clubs contained in said compartments and to a second position to permit removal of the golf clubs, in said first position said locking member constricting said openings to engage the golf clubs; and (d) said tracking means comprising a first tracking guide attached to one side of the interior of the golf bag and a second tracking guide attached to another side of the interior of the golf bag and being disposed parallel to said first tracking guide, and said locking member having rail members for cooperating with said tracking guides.

3. The golf club locking device as claimed in claim 1 or 2, wherein said locking member includes a bar for each of said compartments, and said bar spanning said compartment and in said second position operating to constrict said opening and thereby engage said golf clubs.

4. The golf club locking device as claimed in claim 3, wherein said bar includes a club protection layer on the edge of the bar contacting the shafts of the golf clubs.

5. The golf club locking device as claimed in claim 3, wherein said openings and said bars having complimentary contoured shapes, so that positioning of the shafts of the golf clubs in the constricted openings is facilitated.

6. The golf club locking device as claimed in claim 5, wherein said locking device has a sloped elevation.

7. The golf club locking device as claimed in claim 1 or 2, further including a control panel having an actuator for moving said locking member between said first position and said second position.

8. The golf club locking device as claimed in claim 7, wherein said control panel includes lock means for locking said locking member in said first position and in said second position.

9. A golf club locking device for a golf club bag, the golf club bag having a main portion divided into one or more compartments and a mouth portion forming openings in the bag for receiving golf clubs in the compartments, said golf club locking device comprising:

(a) a main member having means for attaching to the mouth of the golf club bag, and said main member having openings communicating with said compartments;

(b) locking member comprising a shutter for each of said compartments, each of said shutters being coupled at one point to said main member and at another point to an actuator arm, and said actuator arm moving said shutters between a closed and an open position, and in said closed position said shutters constricting said openings to engage the shafts of the golf clubs; and (c) tracking means for linearly guiding movement of said actuator arm in relation to said main member to a first position to prevent removal of golf clubs contained in said compartments and to a second position to permit removal of the golf clubs.

10. A securable golf bag comprising:

(a) a main portion divided into a plurality of compartments and a mouth portion forming openings in the bag for receiving golf clubs in the compartments; and (b) a golf club locking device comprising, (i) a main member having means for attaching to the mouth of said golf club bag, and said main member having openings communicating with said compartments;

(ii) a locking member disposed below said main member; and (iii) tracking means for linearly guiding movement of said locking member in relation to said main member to a first position to prevent removal of golf clubs contained in said compartments and to a second position to permit removal of said golf clubs, in said first position said locking member constricting said openings to engage said golf clubs; and (iv) said tracking means comprising a channel and a transverse flange, said channel having a restrictive opening and being affixed to the lower surface of said main member, and said transverse flange being affixed to the upper surface of said locking member and held captive in said channel, so that said channel in cooperation with said transverse flange guides the linear movement of said locking member.

11. A securable golf bag comprising:

(a) a main portion divided into a plurality of compartments and a mouth portion forming opening in the baa for receiving golf clubs in the compartments; and (b) a golf club locking device comprising, (i) a main member having means for attaching to the mouth of said golf club bag, and said main member having openings communicating with said compartments;

(ii) a locking member disposed below said main member; and (iii) tracking means for linearly guiding movement of said locking member in relation to said main member to a first position to prevent removal of golf clubs contained in said compartments and to a second position to permit removal of said golf clubs, in said first position said locking member constricting said openings to engage said golf clubs; and (c) said tracking means comprising a first tracking guide attached to one side of the interior of the golf bag and a second tracking guide attached to another side of the interior of the golf bag and being disposed parallel to said first tracking guide, and said locking member having rail members for cooperating with said tracking guides.

12. A securable golf bag comprising:

(a) a main portion divided into a plurality of compartments and a mouth portion forming openings in the be for receiving golfclubs in the compartments; and (b) a golf club locking device comprising, (i) a main member having means for attaching to the mouth of said golf club bag, and said main member having openings communicating with said compartments:

(ii) a locking member comprising a shutter for each of said compartments, each of said shutters being coupled at one point to said main member and at another point to an actuator arm, and said actuator arm moving said shutters between a closed and an open position, and in said closed position said shutters constricting said openings to engage the shafts of the golf clubs; and (iii) tracking means for linearly guiding movement of said actuator arm in relation to said main member to a first position to prevent removal of golf clubs contained in said compartments and to a second position to permit removal of the golf clubs.

13. In combination with a golf bag having a main portion divided into one or more compartments and a mouth portion forming openings in the bag for receiving golf clubs in the compartments, said golf club locking device comprising:

(a) a main member having means for attaching to the mouth of said golf club bag, and said main member having openings communicating with said compartments;

(b) a locking member disposed below said main member;

(c) tracking means for linearly guiding movement of said locking member in relation to said main member to a first position to prevent removal of golf clubs contained in said compartments and to a second position to permit removal of said golf clubs, in said first position said locking member constricting said openings to engage the shafts of the golf clubs;

(d) said tracking means comprising a first tracking guide attached to one side of the interior of the golf bag and a second tracking guide attached to another side of the interior of the golf bag and being disposed parallel to said first tracking guide, and said locking member having rail members for cooperating with said tracking guides; and (e) lock means for locking said device in said first and second positions.

14. The golf club locking device as claimed in claim 13, further including a control panel for accessing said lock means and including an actuator for moving said locking member between said first position and said second position.

15. A golf bag comprising:

(a) a body portion having a plurality of dividers, said dividers having one end attached to the bottom of the golf bag and forming compartments;

(b) a mouth portion for providing access to the body portion for inserting golf clubs in the compartments, and said mouth portion including, (i) a main member having means for attaching to the mouth portion of the golf club bag, and said main member having openings communicating with said compartments;

(ii) a moving member disposed below said main member, and said moving member including fastener means for fastening the other end of each of said dividers;

(iii) tracking means for guiding movement of said moving member in relation to said main member, and said dividers moving in cooperation with said moving member.

16. In combination with a golf bag having a main portion divided into one or more compartments and a mouth portion forming openings in the bag for receiving golf clubs in the compartments, said golf club locking device comprising:

(a) a main member having means for attaching to the mouth of said golf club bag, and said main member having openings communicating with said compartments;

(b) a locking member disposed below said main member;

(c) tracking means for linearly guiding movement of said locking member in relation to said main member to a first position to prevent removal of golf clubs contained in said compartments and to a second position to permit removal of said golf clubs, in said first position said locking member constricting said openings to engage the shafts of the golf clubs;

(d) said tracking means comprising a channel and a transverse flange, said channel having a restrictive opening and being affixed to the lower surface of said main member, and said transverse flange being affixed to the upper surface of said locking member and held captive in said channel, so that said channel in cooperation with said transverse flange guides the linear movement of said locking member:and (e) lock means for locking said device in said first and second positions.

* * * * *

UNITED STATES PATENT AND TRADEMARK OFFICE

CERTIFICATE OF CORRECTION

PATENT NO. : 6,196,385 B1 
DATED : March 6, 2001
INVENTOR(S) : Garth Wade Thompson et al.

It is certified that error appears in the above-identified patent and that said Letters Patent is hereby corrected as shown below:

Drawings,
Sheet 4, Fig. 6, the reference numeral 77 should be applied to the strap secured to the bag.
Sheet 5, Fig. 7 should appear as follows:

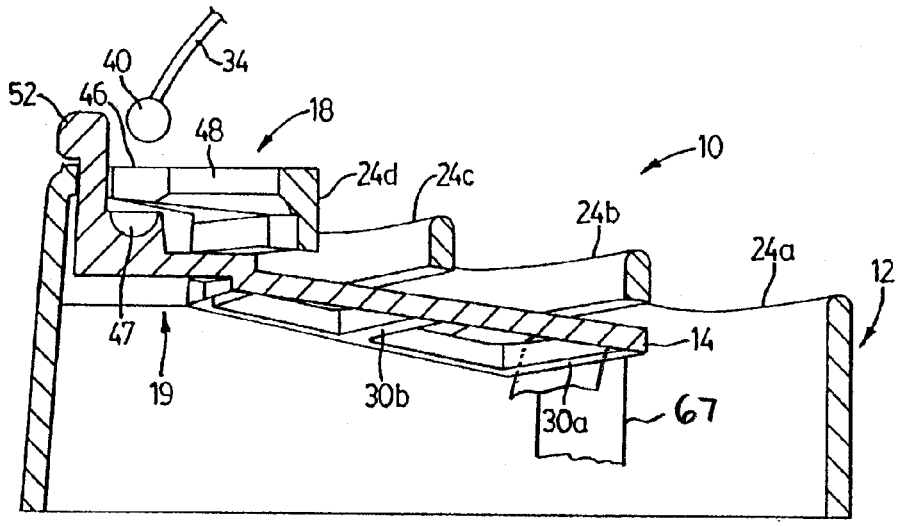

FIG. 7

Column 6,
Line 36, cancel "FIG. 1" and insert -- FIG. 7 --.
Line 65, cancel ""T"0shape" and insert -- "T"-shape --.

UNITED STATES PATENT AND TRADEMARK OFFICE

CERTIFICATE OF CORRECTION

PATENT NO. : 6,196,385 B1 
DATED : March 6, 2001
INVENTOR(S) : Garth Wade Thompson et al.

It is certified that error appears in the above-identified patent and that said Letters Patent is hereby corrected as shown below:

Column 10,
Line 61, cancel "the skirt 77 on the top member 12" and insert -- the skirt formed by the member 12 --.

Signed and Sealed this

Twenty-second Day of April, 2003

JAMES E. ROGAN
*Director of the United States Patent and Trademark Office*